US005333876A

United States Patent [19]

Goto

[11] Patent Number: 5,333,876

[45] Date of Patent: Aug. 2, 1994

[54] GOLF PRACTICE APPARATUS

[75] Inventor: Kyohei Goto, Osaka, Japan

[73] Assignee: Kaisei Engineering Co., Ltd., Osaka, Japan

[21] Appl. No.: 79,781

[22] Filed: Jun. 22, 1993

[51] Int. Cl.[5] ..... A63B 69/36

[52] U.S. Cl. ..... 273/195 B; 273/176 H

[58] Field of Search ..... 273/195 B, 187 R, 176 H, 273/33 R, 187.1, 197 R, 197 A, 196; 472/48, 91, 107; 414/247

[56] References Cited

U.S. PATENT DOCUMENTS

| | | | |
|---|---|---|---|
| 879,275 | 2/1908 | Lacomme | 472/48 |
| 1,454,775 | 5/1923 | Unger | 472/48 |
| 2,815,872 | 12/1957 | Graham | 414/247 |
| 2,916,167 | 12/1959 | Graham | 472/107 |
| 3,522,947 | 8/1970 | Anderson | 273/195 B |
| 3,639,923 | 2/1972 | Stewart | 273/187 R |
| 4,613,133 | 9/1986 | Selberg et al. | 273/195 B |
| 4,790,538 | 12/1988 | Gettelfinger | 273/176 H |
| 5,046,741 | 9/1991 | Ahn | 273/195 B |
| 5,172,914 | 12/1992 | Primerano | 273/176 H |

*Primary Examiner*—Mark S. Graham

*Attorney, Agent, or Firm*—Armstrong, Westerman, Hattori, McLeland & Naughton

[57] ABSTRACT

A golf practice apparatus for simulating sloping ground like the ground of a golf course comprises a table the upper surface of which is covered by a covering such as artificial grass, a supporting member to which the table is pivotally attached disposed along the latitudinal centerline of the underside of the table, and an inclining means wherein a plurality of chains have first ends pivotally attached to the underside of the table at points symmetrical about the supporting member and second ends fixed to a slide device free to move only in the horizontal direction and wherein said chains pass over rollers disposed beneath said points.

Using a golf practice apparatus constructed according to the present invention, the kind of sloping ground found on actual golf courses can be simulated, and realistic practice can be done.

10 Claims, 2 Drawing Sheets

GOLF PRACTICE APPARATUS

DETAILED DESCRIPTION OF THE DEVICE

This present invention device relates to a golf practice apparatus for simulating sloping ground like the ground of a golf course fairway.

DESCRIPTION OF THE PRIOR ART

A conventional golf practice apparatus has a support for a golf ball mounted on a horizontal table with an artificial grass covering on its upper surface, and the user practices golf by placing a golf ball on the ball support and striking it with a golf club.

However, whereas in a conventional apparatus the table on which the player stands and on which the ball is placed is always horizontal, on an actual golf course about the only places where shots are played on ground that is horizontal like this are the tee grounds, and so practice using this kind of conventional practice apparatus is not very realistic. For this reason, because however well a golfer can hit shots on a conventional practice apparatus it is all for nothing if he or she cannot make good shots on the sloping ground surfaces of a golf course, a practice apparatus having a table which can be put into a sloping position is needed.

As a solution to this problem, a golf practice apparatus according to the present invention is comprised of a table with a covering of artificial grass on its upper surface, a supporting member to which the table is pivotally attached disposed along the latitudinal centerline of the underside of the table, and means wherein chains each pivotally attached at one end to the underside of the table at points symmetrical about the supporting member pass around rollers mounted beneath said points and are each attached at the other end to a slider device free to move only horizontally. For safety, the chains are disposed symmetrically and fixed to arms so that even if one of the chains, which are connected to the slide device through stoppers pivotally attached to the arms, breaks in tension, no accident will occur.

Also, by such expedients as making the table square or circular, and using two apparatuses positioned side by side, band providing undulations on part or all of the upper surface of the table, a wide variety of settings corresponding to situations likely to arise on an actual golf course can be made. And a ball support which is always vertical can be provided in an appropriate position on the table, and an automatic ball feeder can be connected to the ball support.

With a golf practice apparatus constructed according to the present device, by putting the table into the horizontal position, conventional practice is possible. To practice shots on a slope, a drive means is used to move the slide device longitudinally (where longitudinally means in the direction in which the ball is to be hit), so that for example when a right handed player wants to practice uphill lie shots, the slider is slid forwards and the other ends of the chains fixed to the slider via pulleys are pulled so that with the support member as the axis the rear part of the table moves down and the front part of the table moves up so that the desired sloping surface is is obtained.

DESCRIPTION OF THE PREFERRED EMBODIMENT

Figure 1:
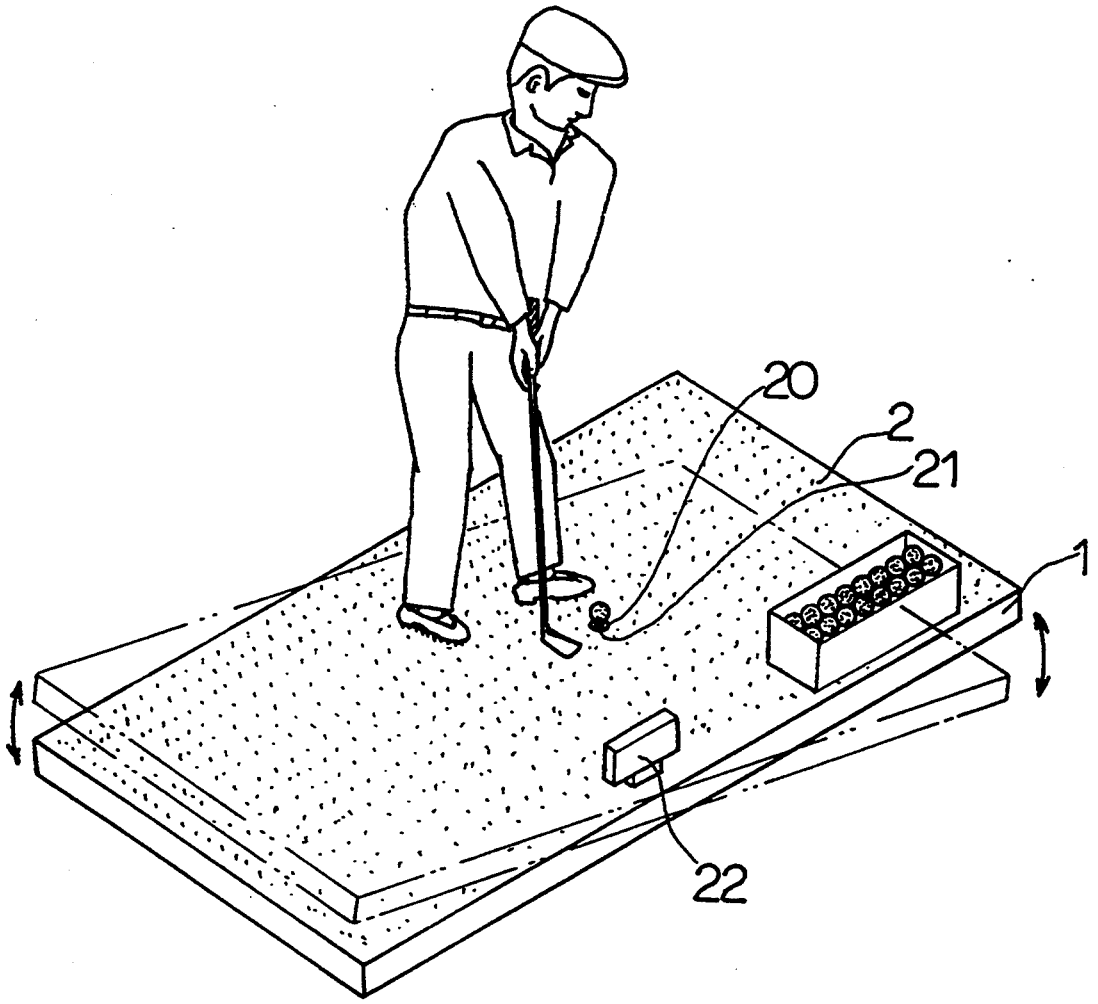
FIG. 1 is a perspective view of a golf practice apparatus according to a preferred embodiment of the present invention.
Figure 2:
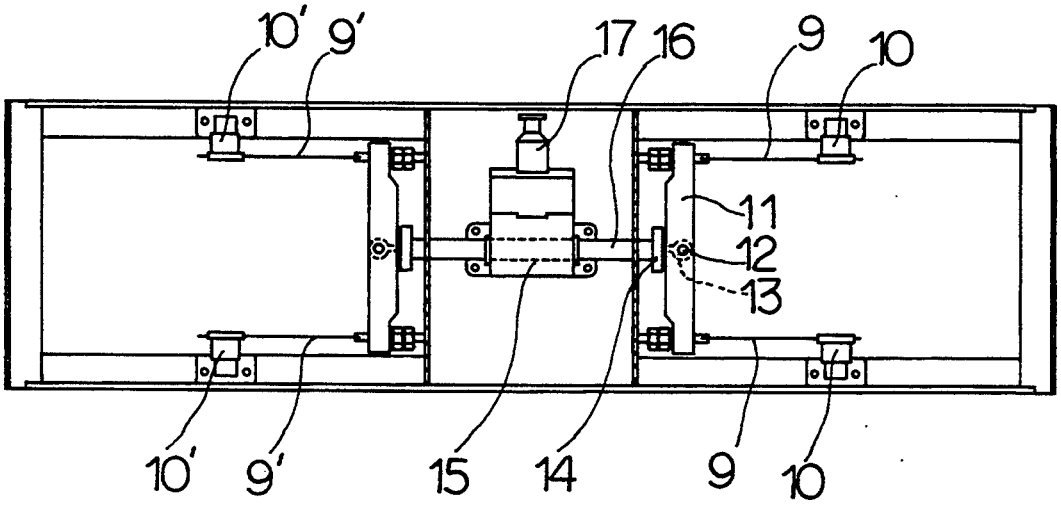
FIG. 2 is a cross-sectional plan view of the golf practice apparatus shown in FIG. 1.

The device will now be explained in further detail with reference to the preferred embodiment shown in the drawings. FIG. 1 shows a preferred embodiment of the device use, FIG. 2 is a cross-sectional plan of a preferred embodiment of the device, and FIG. 3 is a cross-sectional side elevation of a preferred embodiment of the device.

In the drawings, reference numeral 1 denotes a rectangular table covered on its upper surface with an artificial turf 2. For table 1, as shown in FIG. 3, a metal or wooden skeleton 3 of honeycomb structure is used to provide a table which is both light and strong, and the artificial turf 2 is laid on top of this skeleton 3. A supporting shaft member 4 for supporting this table 1 is mounted latitudinally along the length of the table, in a concave area 6 provided in the underside of the table, and shaft beds 7 complete the supporting assembly 5. Two pairs of pins 8,8', located symmetrically about the supporting assembly 5, are pivotally attached to the underside of the table 1, and two pairs of metal chains 9,9' are fixed to these pins. These chains 9,9' pass over rollers 10,10' located approximately beneath the pins 8,8', and, as shown in FIG. 2, are attached to the ends of arms 11, which are oriented latitudinally. A vertically oriented shaft 12 is provided in the middle of each of these arms 11, and rod pins 13 are pivotally attached to the shafts 12, so that the tensions in the chains 9,9' are equalized. These rod pins 13 pass through stopper plates 14, which are somewhat long in the latitudinal direction, and are fixed or pivotally attached to the ends of the slider arm 16, which is free to move only in the longitudinal direction, of a slide device 15 disposed underneath the supporting assembly 5, so that the arms 11 are held adjacent, with a slight gap, to the stopper plates 14, and the stopper plates 14 are thereby also fixed to the slider arm 16. The above-mentioned slide device 15 is connected to a reversible drive motor 17, and covered by a box frame 18 with openings provided for the arm 16 to project through, and the support assembly 5 is welded or bolted to the top of this box frame 18.

Figure 3:
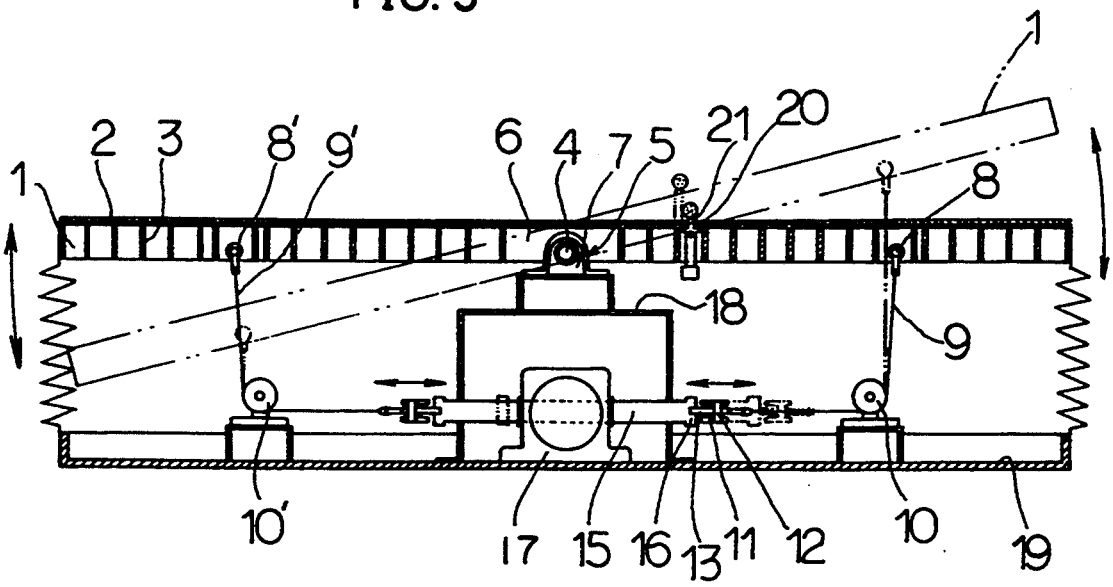
FIG. 3 is a cross-sectional side elevation of the golf practice apparatus.

In a golf practice device constructed as described above, when the drive motor 17 is operated by a switch fitted to the table 1 or fitted in a place other than on the golf practice apparatus, the motor 17 runs in its forward or reverse direction and the arm 16 of the slide device 15 connected to the motor 17 is caused to move, for example to the right as shown in FIG. 3 by broken lines. The arms 11, connected to the slider 16 by the rod pins 13, also move to the right. The chains 9,9' fixed to the arm 11 shown on the left in FIG. 3 pull the table down, and the table 1 rises on the right by the same amount. Then, when the desired angle of inclination has been reached, the drive motor 17 is switched off and the table 1 is held in this sloping position by the chains on the side of the table which is low, in this case the chains 9' in FIG. 3. The use of a geared motor provided with a rotation control device, for the drive motor 17, is desirable from the safety point of view.

If a player stands on the table 1 and faces one side, and sets the table 1 into a desired position by the method described above, the player can for example simulate an uphill address with his left foot high, as shown in FIG. 1, or, by reversing the table position, a downhill address. Alternatively, if the player faces the front of the apparatus he can simulate an address in which he faces uphill or one in which he faces downhill. At a golf practice range balls can usually only be hit in one direction, but, by making the table 1 square or circular and providing means by which the mounting plate 19 can be turned through 90°, uphill and downhill addresses, uphill-facing and downhill-facing addresses, and combinations of these such as uphill-facing downhill addresses etc. can be simulated without changing the direction in which the ball is hit.

Also, by providing a suitably located hole 20 in the table 1 and a ball stand above the surface of the table connected by an arm passing through the hole to a ball support 21 pivotally attached to the above-mentioned table skeleton 3 so that the ball support 21 remains oriented vertically irrespective of the angle of inclination of the table, the ball can be teed up and will not roll even when the table is inclined. Furthermore, by connecting up a conventional automatic ball feeder to the ball support, the player can be relieved of the task of setting up balls by hand. Also, although this is not presented in a drawing as another preferred embodiment, part or all of the upper surface of the table 1 can be given undulations, to simulate rough ground. And if two of the practice apparatuses are provided side by side, situations such as that in which the ground on which the player is standing slopes in the opposite direction to the ground on which the ball lies can also be simulated.

Also, an angle display device 22 to show the angle of slope of the table 1 can be provided and mounted on table 1.

Using a golf practice apparatus constructed according to the present device, the kind of sloping ground found on actual golf courses can be simulated, and realistic practice can be done.

Also, because two chains are fixed to each arm and the tensions in the chains are equalized, table unsteadiness is prevented, and the table is safe because in the unlikely event of any of the chains breaking while the table is inclined, the arm on the relevant side will contact with the stopper plate and the other chain in tension will support the table, preventing it from falling.

Furthermore, if the table is made square or circular the apparatus can be easily turned through 90° and not just uphill and downhill addresses but a wide variety of different address situations can be simulated. And if the surface of the table is given undulations, awkward ball lies can be simulated.

And, by providing an always vertical ball stand in an appropriate location on the table so that the ball is prevented from rolling when the table is inclined, and by connecting up a conventional ball feeder to this ball support to relieve the player of the task of setting up balls one by one, the player can be allowed to concentrate solely on his golf practice.

What is claimed is:

1. A golf practice apparatus comprising a table having an upwardly facing playing surface, a supporting shaft member disposed along the latitudinal centerline of the underside of said table, means for fixedly attaching said table to said shaft member, means journaling said shaft member for pivotal movement, and table-inclining means including a slide device disposed along the underside of the table mounted for slidable movement in a horizontal direction, a plurality of chains have first ends pivotally attached to the underside of the table at connecting points symmetrical about the shaft member and second ends fixed to said slide device, and a roller beneath each of said connecting points for guiding each of said chains.

2. A golf practice apparatus according to claim 1, including plate-like arms fixing said second ends of said chains and stopper plates pivotally attached to said plate-like arms and connecting said plate-like arms to said slide device.

3. A golf practice apparatus according to claim 1, wherein the table is circular.

4. A golf practice apparatus according to claim 1, further comprising a plurality of the golf practice apparatuses positioned side by side.

5. A golf practice apparatus according to claim 1, wherein said playing surface of the table is provided with an undulating form.

6. A golf practice apparatus according to claim 1, including a ball support appropriately positioned on said table, and means for pivotally mounting said ball support with respect to said table such that it is always oriented vertically.

7. A golf practice apparatus according to claim 6, including an automatic ball feeder connected to the ball support.

8. A golf practice device according to claim 1 including a covering on said playing surface.

9. A golf practice device according to claim 8 in which said covering is artificial grass.

10. A golf practice apparatus according to claim 1, wherein said table is rectangular.

* * * * *